US012024214B2

(12) United States Patent
Seenumani et al.

(10) Patent No.: US 12,024,214 B2
(45) Date of Patent: Jul. 2, 2024

(54) VEHICLE CONTROL SYSTEM

(71) Applicant: Transportation IP Holdings, LLC, Norwalk, CT (US)

(72) Inventors: Gayathri Seenumani, Niskayuna, NY (US); Harry Kirk Mathews, Jr., Niskayuna, NY (US); James D. Brooks, Schenectady, NY (US)

(73) Assignee: Transportation IP Holdings, LLC, Norwalk, CT (US)

( * ) Notice: Subject to any disclaimer, the term of this patent is extended or adjusted under 35 U.S.C. 154(b) by 499 days.

(21) Appl. No.: 16/722,370

(22) Filed: Dec. 20, 2019

(65) Prior Publication Data

US 2021/0188336 A1 Jun. 24, 2021

(51) Int. Cl.

| | |
|---|---|
| ***B61L 27/40*** | (2022.01) |
| ***B61L 3/08*** | (2006.01) |
| ***B61L 27/16*** | (2022.01) |

(52) U.S. Cl.

CPC ..... *B61L 27/40* (2022.01); *B61L 3/08* (2013.01); *B61L 27/16* (2022.01); *B61L 2205/04* (2013.01)

(58) Field of Classification Search

None

See application file for complete search history.

(56) References Cited

U.S. PATENT DOCUMENTS

| | | | | |
|---|---|---|---|---|
| 9,950,722 | B2 * | 4/2018 | Kumar | B61L 27/40 |
| 2009/0118970 | A1 * | 5/2009 | Daum | B61L 3/006 701/102 |
| 2012/0245770 | A1 * | 9/2012 | Yamamoto | B61L 3/008 701/20 |
| 2014/0222259 | A1 * | 8/2014 | Yoshimoto | B61L 27/16 701/20 |
| 2016/0019792 | A1 * | 1/2016 | Kawamata | G07C 5/085 701/70 |
| 2016/0040995 | A1 * | 2/2016 | Kano | G01L 7/00 701/123 |
| 2017/0190340 | A1 * | 7/2017 | Jung | B61L 3/008 |

* cited by examiner

*Primary Examiner* — Adam D Tissot

(74) *Attorney, Agent, or Firm* — K&L Gates LLP

(57) ABSTRACT

A system and method that includes determining a relationship between a moving resistance of a vehicle system and one or more characteristics of the vehicle system. A trip plan may be generated based at least in part on the relationship for movement of the vehicle system through one or more sections of one or more routes based at least in part on the relationship. One or more operational settings of the vehicle system are then designated for implementing the trip plan to drive movement of the vehicle system to achieve one or more objectives.

20 Claims, 2 Drawing Sheets

VEHICLE CONTROL SYSTEM

BACKGROUND

Technical Field

Embodiments of the subject matter described herein relate to controlling movement of a vehicle system.

Discussion of Art

Vehicle systems may travel on trips along routes from a starting or departure location to destination or arrival location. Each trip may extend along the route for long distances, and the trip may include one or more designated stops prior to reaching the arrival location. These designated stops may be for a crew change, refueling, picking up or dropping off passengers and/or cargo, and the like.

Some vehicle systems travel according to trip plans that provide instructions for the vehicle system to implement during movement of the vehicle system such that the vehicle system meets or achieves certain objectives during the trip. The objectives for the trip may include reaching the arrival location at or before a predefined arrival time, increasing fuel efficiency (relative to the fuel efficiency of the vehicle system traveling without following the trip plan), abiding by speed limits and emissions limits, or the like. The trip plans may be generated to achieve the specific objectives, so the instructions provided by the trip plans are based on those specific objectives.

A trip algorithm for vehicle systems can be one manner in which a trip plan may be implemented. A trip algorithm utilizes parameters related to the both the vehicle and route to determine operational settings of the vehicle system during the trip to meet the specific desired objectives. The parameters may include vehicle parameters, including the type of vehicle, engine efficiencies, amount of propulsion vehicles to non-propulsion vehicles in the vehicle system, the weight of the vehicle system, etc. The parameters may also include environmental parameters that may include route terrain, potential stops for refueling, recharging, and/or maintenance, rules and regulations associated with different sections of the route, and the like. As an example, fuel prices may vary between cities, states, counties, etc., and consequently, refueling in a low-cost location can bring a trip closer to meeting cost-based objectives for a trip. So, a trip algorithm may be provided to account for numerous variables in determining a trip plan that meets a desired objective, for either a section of a trip, or for the entire trip.

The route(s) of a trip may be logically broken up into different sections, with different operating parameters required to meet an overall trip objective. For example, during a trip, there are typically sections where the vehicle may need to slow down. For example, areas where traffic congestion may be predicted typically requires the slowing of the vehicle. To this end, for vehicles, such as vehicles that may operate autonomously, areas where vehicle handling occurs may also cause a slowdown. In other instances, differing speed limits may exist along sections of a route. The speed limits may be based on government regulations, changing once a boundary is crossed. Similarly, different emission standards may be presented depending on the location of the vehicle that may affect the speed of the vehicle. In each example, the speed of the vehicle changes based on the location of a section of a route. As a result, in a trip plan, speed limits for each section may be provided; however, such methodology often burns more fuel, or energy than needed. Specifically, static rules such a maintaining a vehicle at a constant speed in a given section of a route may cause inefficiencies by not considering the dynamic nature of traveling along any given route.

BRIEF DESCRIPTION

In accordance with one embodiment, a method may be provided that includes determining a relationship between a moving resistance of a vehicle system and one or more characteristics of the vehicle system, and generating a trip plan based at least in part on a relationship for movement of the vehicle system through one or more sections of one or more routes based at least in part on the relationship. One or more operational settings of the vehicle system may be designated for implementing the trip plan to drive movement of the vehicle system to achieve one or more objectives.

In accordance with one embodiment, a system may be provided that may include a controller. The controller may include one or more processors configured to determine a relationship between a moving resistance of a vehicle system and one or more characteristics of the vehicle system, generate a trip plan based at least in part on a relationship for movement of the vehicle system through one or more sections of one or more routes based at least in part on the relationship, and designate one or more operational settings of the vehicle system for implementing the trip plan to drive movement of the vehicle system to achieve one or more objectives.

In accordance with one embodiment, a method may be provided that includes determining a relationship between an air resistance of a vehicle system and one or more characteristics of the vehicle system. The relationship may include at least one drag coefficient. The method may also include generating a trip plan based at least in part on a relationship for movement of the vehicle system through one or more sections of one or more routes based at least in part on the relationship, designating one or more operational settings of the vehicle system for implementing the trip plan to drive movement of the vehicle system to achieve one or more objectives, and determining a modified version of the relationship between the air resistance of the vehicle system and the one or more characteristics of the vehicle system based on the one or more sections of the one or more routes.

BRIEF DESCRIPTION OF THE DRAWINGS

The inventive subject matter may be understood from reading the following description of non-limiting embodiments, with reference to the attached drawings, wherein below.

DETAILED DESCRIPTION

Embodiments of the subject matter described herein relate to varying a parameter that affects determinations related to vehicle speed within a section of one or more routes during a trip to generate or modify a trip plan. In particular, when reduced speed in a section is identified within a trip plan, instead of reducing the speed to a constant reduced speed that does not take into account environmental or vehicle based parameters, a parameter of a relationship that determines vehicle speed for the section may be varied to account for the reduced speed. A relationship as used herein includes any and all determinations, calculations, etc. that may be used to restrict the speed of a vehicle system within a section of one or more routes of a trip.

As an example, air resistance equations may be used in determining fuel efficiency of a vehicle system along a section. When air resistance increases, to increase fuel efficiency, vehicle speed may be correspondingly decreased. Specifically, in determining how a tractive effort of a vehicle may be affected by resistance during a trip, an equation may be used that includes a constant, a linear component, and a quadratic component to represent speed dependent resistance. As a result of the speed dependent resistance, drag coefficients are then used with the linear component and quadratic component to minimize the effect of resistance. These drag coefficients are sometimes referred to as Davis coefficients. So, in this example, instead of using the previously determined drag coefficients when determining tractive effort, the drag coefficients are varied based on the reduced speed determined for a section. Because the drag coefficients are varied, or increased, a larger penalty may be determined for increased speed within the section. As a result, the vehicle slows during the reduced speed section, but may be still varied within the section to provide better travel times and fuel efficiencies as compared to just keeping the speed constant in the reduced speed section.

Figure 1:
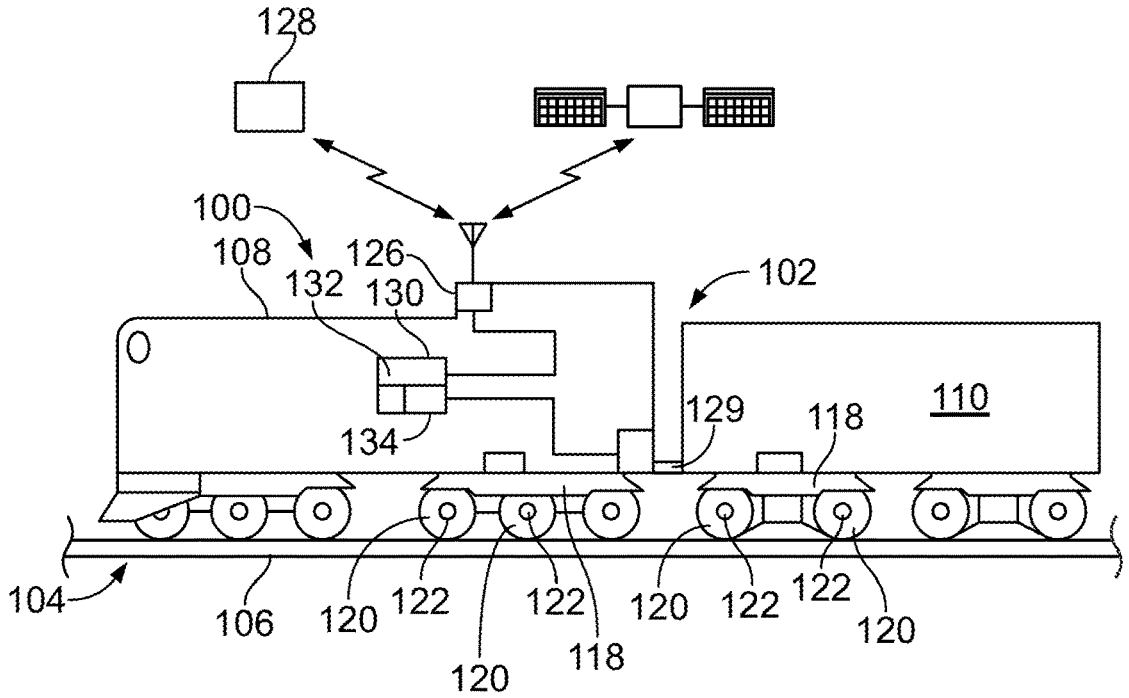
FIG. 1 is a schematic diagram of an energy management system.

FIG. 1 illustrates a schematic diagram of an energy management system 100 according to an embodiment. The energy management system may be disposed on a vehicle system 102. The vehicle system may be configured to travel along a route 104 on a trip from a starting or departure location to a destination or arrival location. The vehicle system includes one or more vehicles. For example, the vehicle system may include one or more propulsion-generating vehicles 108. Optionally, the vehicle system may include one or more non-propulsion-generating vehicles 110. In embodiments where the vehicle system includes two or more vehicles, the vehicles may be mechanically interconnected with each one. Alternatively, the vehicles of such a multi-vehicle vehicle system may not be mechanically coupled with each other. For example, the vehicles may be separate but logically coupled with each other by communicating with each other to move along one or more routes as a group (e.g., a convoy).

In the example of FIG. 1, the vehicles of the vehicle system each may include multiple wheels 120 that engage the route, and at least one axle 122 that couples left and right wheels together (only the left wheels are shown in FIG. 1). Optionally, the wheels and axles are located on one or more trucks or bogies 118. Optionally, the trucks may be fixed-axle trucks, such that the wheels are rotationally fixed to the axles, so the left wheel rotates the same speed, amount, and at the same times as the right wheel. The vehicles in a vehicle system may be mechanically coupled with each other, such as by couplers. For example, the propulsion vehicle can be mechanically coupled to the car by a coupler 123.

The coupler may have a draft gear configured to absorb compression and tension forces to reduce slack between the vehicles. Although not shown in FIG. 1, the propulsion vehicle may have a coupler located at a rear end of the car for mechanically coupling the respective vehicles to additional vehicles in the vehicle system. Alternatively, the vehicles in a vehicle system may not be mechanically coupled with each other, but may be logically coupled with each other. For example, the vehicles may be logically coupled with each other by the vehicles communicating with each other to coordinate the movements of the vehicles with each other so that the vehicles travel together in a convoy or group as the vehicle system.

In one embodiment, the vehicle system may be a rail vehicle system, and the route may be a track formed by one or more rails. The propulsion vehicle may be a locomotive, and the car may be a rail car that carries passengers and/or cargo. Alternatively, the propulsion vehicle may be another type of rail vehicle other than a locomotive. In an alternative embodiment, the vehicle system may be one or more automobiles, marine vessels, aircraft, mining vehicles, agricultural vehicles, or other off-highway vehicles (OHV) system (e.g., a vehicle system that is not legally permitted and/or designed for travel on public roadways), or the like. While some examples provided herein describe the route as being a track, not all embodiments are limited to a rail vehicle traveling on a railroad track. One or more embodiments may be used in connection with non-rail vehicles and routes other than tracks, such as roads, paths, waterways, or the like.

The propulsion-generating vehicle includes a propulsion subsystem that generates tractive effort to propel the vehicle system. This propulsion subsystem can include components such as traction motors that propel the vehicle system. The propulsion-generating vehicle also can include a braking system that generates braking effort for the vehicle system to slow down or stop the vehicle system from moving. Optionally, the non-propulsion-generating vehicle includes a braking system but not a propulsion subsystem. The propulsion-generating vehicle may be referred to herein as a propulsion vehicle, and the non-propulsion-generating vehicle may be referred to herein as a car. Although one propulsion vehicle and one car are shown in FIG. 1, the vehicle system may include multiple propulsion vehicles and/or multiple cars. In an alternative embodiment, the vehicle system only includes the propulsion vehicle such that the propulsion vehicle is not coupled to the car or another kind of vehicle.

The energy management system controls the movements of the vehicle system. In one example, the energy management system may be disposed entirely on the propulsion vehicle. In other embodiments, however, one or more components of the energy management system may be distributed among several vehicles, such as the vehicles that make up the vehicle system. For example, some components may be distributed among two or more propulsion vehicles that are coupled together in a group or consist. In an alternative embodiment, at least some of the components of the energy management system may be located remotely from the vehicle system, such as at a dispatch location. The remote components of the energy management system may communicate with the vehicle system (and with components of the energy management system disposed thereon).

The energy management system may include a communication system 126 that communicates with vehicles in the vehicle system and/or with remote locations, such as a remote (dispatch) location 128, other vehicle systems, etc. The communication system may include a receiver and a transmitter, or a transceiver that performs both receiving and transmitting functions. The communication system may also include an antenna and associated circuitry.

The energy management system has a controller 130 or control unit that may be a hardware and/or software system which operates to perform one or more functions for the vehicle system. The controller receives information from components of the energy management system, analyzes the received information, and generates operational settings for the vehicle system to control the movements of the vehicle system. The operational settings may be contained in a trip plan. The operational settings may include a throttle setting, speed setting, gear setting, auxiliary load setting, energy storage device setting, a brake setting, etc. Specifically, the throttle setting may include any setting, including a notch position that may cause a vehicle system to have tractive force. The speed setting may include a throttle setting, notch position, or the like. The auxiliary load setting may include auxiliary systems of a vehicle system that may be used and create a load on an engine or energy storage device during a trip such as heating or air conditioning units, lift and loading mechanisms, lighting systems, etc. The controller may also have access to, or receive information from, a locator device, a vehicle characterization element, trip characterization element, and at least some of the other sensors on the vehicle system.

The controller of the energy management system further includes a trip characterization element 132. The trip characterization element may be configured to provide information about the trip of the vehicle system along the route. The trip information may include route characteristics, designated locations, designated stopping locations, schedule times, meet-up events, directions along the route, and the like.

For example, the designated route characteristics may include grade, elevation slow warnings, environmental conditions (e.g., rain and snow), and curvature information. The designated locations may include the locations of wayside devices, passing loops, passenger, crew, and/or cargo changing stations, and the starting and destination locations for the trip. At least some of the designated locations may be designated stopping locations where the vehicle system may be scheduled to come to a complete stop for a period of time. For example, a passenger changing station may be a designated stopping location, while a wayside device may be a designated location that is not a stopping location. The wayside device may be used to check on the on-time status of the vehicle system by comparing the actual time at which the vehicle system passes the designated wayside device along the route to a projected time for the vehicle system to pass the wayside device according to the trip plan.

The trip information concerning schedule times may include departure times and arrival times for the overall trip, times for reaching designated locations, and/or arrival times, break times (e.g., the time that the vehicle system may be stopped), and departure times at various designated stopping locations during the trip. The meet-up events include locations of passing loops and timing information for passing, or getting passed by, another vehicle system on the same route. The directions along the route are directions used to traverse the route to reach the destination or arrival location. The directions may be updated to provide a path around a congested area or a construction or maintenance area of the route.

The trip characterization element may be a database stored in an electronic storage device, or memory. The information in the trip characterization element may be input via the user interface device by an operator, may be automatically uploaded, or may be received remotely via the communication system. The source for at least some of the information in the trip characterization element may be a trip manifest, a log, or the like.

In an embodiment, the controller of the energy management system also includes a vehicle characterization element 134. The vehicle characterization element may provide information about the make-up of the vehicle system, such as the type of cars (for example, the manufacturer, the product number, the materials, etc.), the number of cars, the weight of cars, whether the cars are consistent (meaning relatively identical in weight and distribution throughout the length of the vehicle system) or inconsistent, the type and weight of cargo, the total weight of the vehicle system, the number of propulsion vehicles, the position and arrangement of propulsion vehicles relative to the cars, the type of propulsion vehicles (including the manufacturer, the product number, power output capabilities, available notch settings, etc.), and the like.

The vehicle characterization element may be a database stored in an electronic storage device, or memory. The information in the vehicle characterization element may be input using an input/output (I/O) device (referred to as a user interface device) by an operator, may be automatically uploaded, or may be received remotely via the communication system. The source for at least some of the information in the vehicle characterization element may be a vehicle manifest, a log, or the like.

Figure 2:
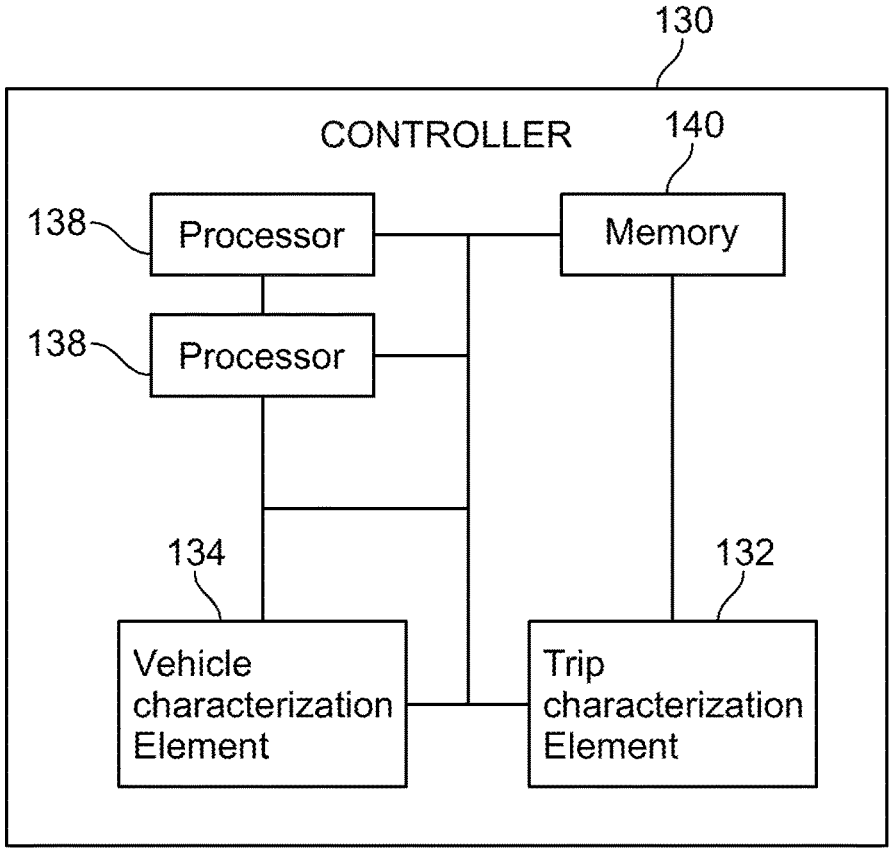
FIG. 2 is a schematic diagram of a controller of an energy management system.

FIG. 2 provides a schematic illustration of the controller that may be configured to control operation of a propulsion vehicle. The controller may be a device that includes one or more processors 138 therein (e.g., within a housing). Each processor may include a microprocessor or equivalent control circuitry. At least one algorithm operates within the one or more processors. For example, the one or more processors may operate according to one or more algorithms to generate a trip plan.

The trip plan designates one or more operational settings for the vehicle system to implement or execute during the trip as a function of distance, time, and/or location along the route. The operational settings may include tractive and braking efforts for the vehicle system. For example, the operational settings may dictate different speeds, throttle settings, notch settings, brake settings, accelerations, or the like, of the vehicle system 102 for different locations, times, and/or distances along the route traversed by the vehicle system 102.

The trip plan can be configured to drive the vehicle system to achieve or increase specific goals or objectives during the trip of the vehicle system, while meeting or abiding by designated constraints, restrictions, and limitations. Some possible objectives include increasing energy (e.g., stored electric current) efficiency, reducing stops for recharging, reducing trip duration, reducing wheel and vehicle wear, reducing audible noise generated by the vehicle system, reducing emissions generated by the vehicle system, or the like.

The constraints or limitations may include speed limits, schedules (such as arrival times at various designated locations), environmental regulations, standards, limits on audible noise, etc. The operational settings of the trip plan may be configured to increase the level of attainment of the specified objectives relative to the vehicle system traveling along the route for the trip according to operational settings that differ from the one or more operational settings of the trip plan (e.g., such as if the human operator of the vehicle system determines the tractive and brake settings for the trip). One example of an objective of the trip plan may be to reduce recharging stops along a route during the trip. By implementing the operational settings designated by the trip plan, the number of recharging stops may be reduced relative to the amount of stops the same vehicle system along the same section of the route in the same time period would make, but not for the trip plan.

The trip plan may be established using an algorithm based on models for vehicle behavior for the vehicle system along the route. The algorithm may include a series of non-linear differential equations derived from applicable physics equations with simplifying assumptions.

For example, a Davis equation may be used to determine speed dependent resistance on a vehicle during a trip, or on a vehicle in a section of one or more routes in a trip. The form of the Davis equation is a quadratic in velocity where R=A+Bv+Cv^2, where R is the resistance, and v is velocity of the vehicle. A, B, and C all represent constants, that may be referred to as drag coefficients, or Davis drag coefficients. In particular, these constants may be determined through experiments, MATLAB determinations, or the like, for a given vehicle. The B constant is considered to be with a linear component v, and the C constant may be considered to be with a quadratic component v^2. Specifically, linear component B may be a speed dependent resistance coefficient that is based on the air resistance of the vehicle as a function of speed. The quadradic component may be a speed dependent resistance coefficient based on friction in relation to the wheel bearings over a trip. The calculated resistance may then be utilized to determine fuel efficiency, speed, etc. of the trip, or section of the trip accordingly.

As an example, in one embodiment a standard point mass representation may be considered in an embodiment for a vehicle system to calculate the tractive power requirement of a trip as provided:

$$dvdt=F/m-g(x)-a-bv-bv2$$

Where v is vehicle system speed, t is a function of time, F is the tractive effort or force, m is vehicle system mass, g(x) if the effective grade of the trip, a and b are Davis drag coefficients and the trapezoidal discretization of the point mass model is:

$$h(Fk,Fk+1,\alpha k,\alpha k+1,\delta xk,a,b,c)=0$$

Where F is the tractive effort or force, k is an index of a mesh point, $\alpha$ is inverse speed, $\delta$xk is xk−xk−1, x is the distance along the trip and is an independent variable, and a, b, and c are Davis drag coefficients. Mesh points are points used to form a network, or in the present instance points or locations along a route of a trip. The index of a mesh point can be used as an identifier of the mesh point (e.g., a first mesh point, a second mesh point, and so on). The vehicle characteristics can be 1D lookup tables or engine fuel-rate interpolated as a function of engine horsepower as given as:

$$\gamma k=\Gamma(Pek)$$

where $\gamma$ is fuel rate burn, k is an index of a mesh point, and Pe is the engine power. In this manner, the drag coefficient constants that are determined may be used as a variable in making determinations related to vehicle speed, fuel efficiency, etc.

In an embodiment, the energy management system may be configured to generate multiple trip plans for the vehicle system to follow along the route during the trip. The multiple trip plans may have different objectives from one another. The difference in objectives may be based on operating conditions of the vehicle system. The operating conditions may include, route or section traffic, vehicle speed, operating temperature, notch position, speed limits, a location of the vehicle system along the route, or the like. Different objectives may include increasing trip speed, reducing stops for charging, reducing fuel use, reducing costs, etc.

In an alternative embodiment, instead of generating multiple different trip plans, the energy management system may be configured to generate a single trip plan that accounts for changing objectives of the vehicle system along the route. For example, the trip plan may constructively divide the trip into multiple sections based on time, location, or a projected speed of the vehicle system along the route. In some of the sections, the operational settings of the trip plan are designated to drive the vehicle system toward achievement of at least a first objective. In at least one other section, the operational settings of the trip plan are designated to drive the vehicle system toward achievement of at least a different, second objective.

The energy management system may be configured to control the vehicle system along the trip based on the trip plan, such that the vehicle system travels according to the trip plan. In a closed loop mode or configuration, the energy management system may autonomously control or implement propulsion and braking subsystems of the vehicle system consistent with the trip plan, without requiring the input of a human operator. In an open loop coaching mode, the operator may be involved in the control of the vehicle system according to the trip plan. For example, the energy management system may present or display the operational settings of the trip plan to the operator as directions on how to control the vehicle system to follow the trip plan. The operator may then control the vehicle system in response to the directions.

With reference to FIG. 2, the controller optionally may also include a controller memory 140, which may be an electronic, computer-readable storage device or medium. The controller memory may be within the housing of the controller, or alternatively may be on a separate device that may be communicatively coupled to the controller and the one or more processors therein. By "communicatively coupled," it is meant that two devices, systems, subsystems, assemblies, modules, components, and the like, are joined by one or more wired or wireless communication links, such as by one or more conductive (e.g., copper) wires, cables, or buses; wireless networks; fiber optic cables, and the like. The controller memory can include a tangible, non-transitory computer-readable storage medium that stores data on a temporary or permanent basis for use by the one or more processors. The memory may include one or more volatile and/or non-volatile memory devices, such as random access memory (RAM), static random access memory (SRAM), dynamic RAM (DRAM), another type of RAM, read only memory (ROM), flash memory, magnetic storage devices (e.g., hard discs, floppy discs, or magnetic tapes), optical discs, and the like.

The controller memory may include one or more algorithms based on models for vehicle behavior for the vehicle system along the route. As indicated above, the algorithm(s) as described may include a series of non-linear differential equations derived from applicable physics equations with simplifying assumptions. Such algorithm(s), non-linear differential equations, physics equations, etc. may include the Davis equation, drag coefficients, a relationship between a moving resistance of the vehicle system along one or more routes for an upcoming trip and one or more characteristics of the vehicle system, etc. Additionally, information and data determined or derived by the one or more processors, trip characterization element, other sensors, global positioning system sensors, vehicle characterization element, battery regulator unit, etc. may be stored in the controller memory for later processing. By using, collecting, and processing this information and data, the controller may determine operational settings for one or more vehicles for a trip plan. In particular, the one or more characteristics of the vehicle system may include vehicle characteristics including as described in relation to the vehicle characterization element, trip characteristics including as described in relation to the trip characterization element, route characteristics including as described herein, or the like.

Optionally, the controller may be configured to communicate at least some of the operational settings designated by the controller in a control signal. The control signal may be directed to the propulsion subsystem, the braking subsystem, or a user interface device of the vehicle system. For example, the control signal may be directed to the propulsion subsystem and may include notch throttle settings of a traction motor for the propulsion subsystem to implement autonomously upon receipt of the control signal.

In another example, the control signal may be directed to a user interface device that displays and/or otherwise presents information to a human operator of the vehicle system. The control signal to the user interface device may include throttle settings for a throttle that controls the propulsion subsystem. The control signal may also include data for displaying the throttle settings visually on a display of the user interface device and/or for alerting the operator audibly using a speaker of the user interface device. The throttle settings optionally may be presented as a suggestion to the operator, for the operator to decide whether or not to implement the suggested throttle settings.

The energy management system may also be configured to make determinations related to the total energy requirements of a trip, fuel consumption during a trip, emission outputs, speed and timing of a trip, terrain and environment constraints, etc. to make determinations related to plural sections of a trip. By making these determinations, the energy management system may determine the location of the plural sections of the trip along one or more routes. As a result, for each individual section, the energy management system may determine that movement of the vehicle system for any given section may be restricted within one or more limits. As an example, certain sections may be located in high population areas, or locations where significant traffic may be known to occur.

Once the energy management system identifies a section where speed restriction within one or more limits should be provided, the energy management system may generate or modify a trip plan to provide the speed restriction. In one example, instead of merely providing a constant speed for an identified section, the trip plan may modify a variable of a calculation related to the velocity of the vehicle system for the identified section to provide a penalty for increased speed.

For example, to determine the operation of the vehicle system along any given section where a speed restriction may be present, a relationship between a moving resistance of a vehicle system the section and one or more characteristics of the vehicle system may be obtained from a computer memory. The relationship obtained in one example may be an air resistance determination related to the vehicle that may be presented as a determined equation. The determined equation may be the Davis equation. In one example, the energy management system may be configured to increase the constant drag coefficients of the air resistance function as a function of a restriction, such as a speed restriction. Therefore, as the vehicle enters a section where speed may be desired to be reduced, the coefficients are increased to reflect the desired decrease in speed. As a result, as predicted speed of the vehicle increases, a greater penalty based on the air resistance determination may be levied. In response, a slower speed for the vehicle may be achieved. Still, because the air resistance remains variable across the section, the speed of the vehicle does not remain constant, and instead dynamically changes with other variables to better match other desired objectives of a trip.

Figure 3:
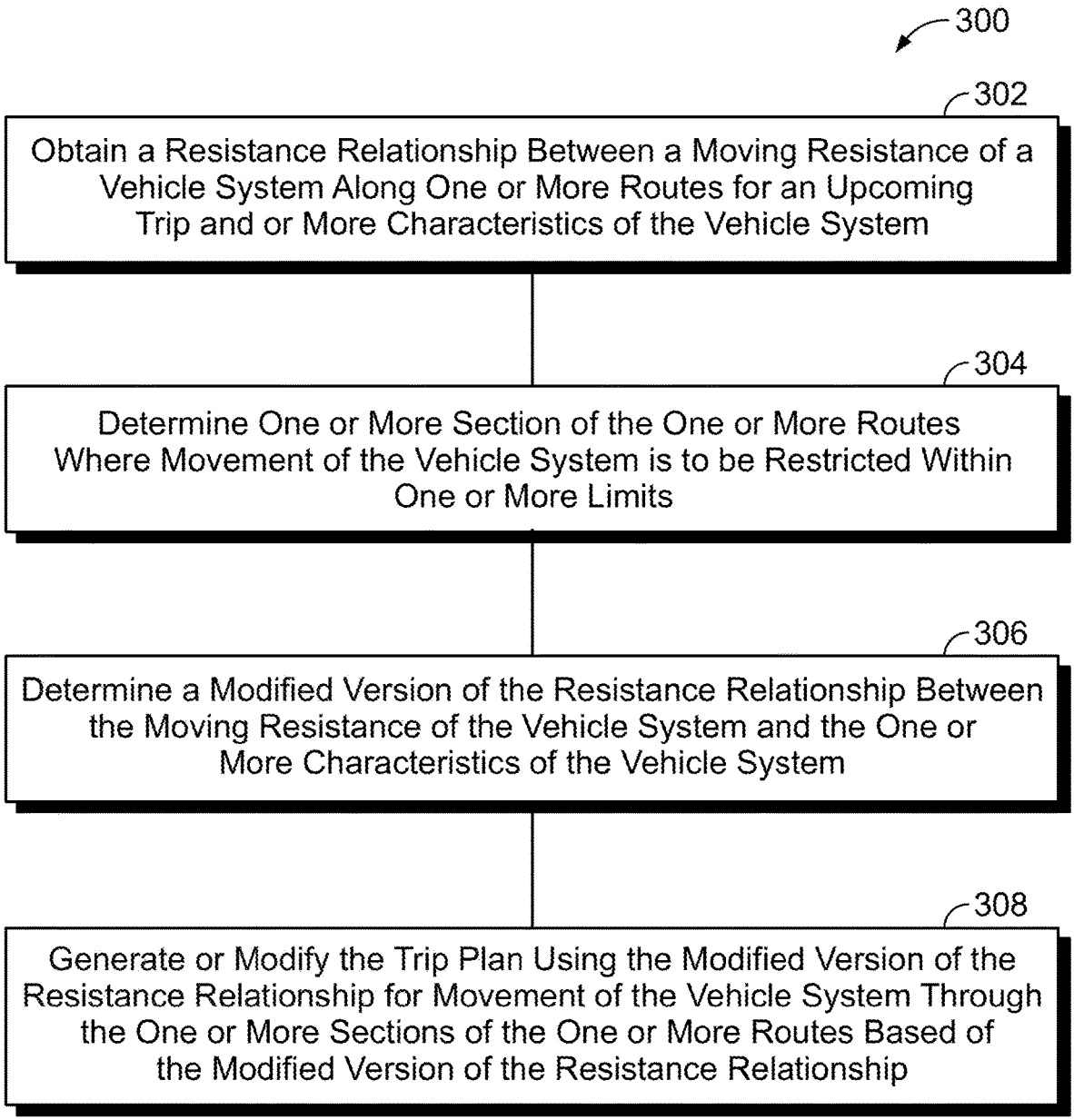
FIG. 3 is process diagram of a method of generating or modifying a trip plan.

FIG. 3 illustrates a method 300 of modifying or generating a trip plan. The method may be implemented by an energy management system as described in FIGS. 1 and 2. The trip plan may be generated and/or modified, where modifying includes updating an existing trip plan during a trip.

At 302, a relationship between a moving resistance of a vehicle system along one or more routes for an upcoming trip and one or more characteristics of the vehicle system may be obtained. The relationship between the moving resistance of the vehicle system and the one or more characteristics of the vehicle system may include models, mathematical formulas, functions, quadradic equations, differential equations, etc. where the moving resistance may be accordingly determined including by using the one or more characteristics as variables in the determination. In one example, the moving resistance may be an air resistance on the vehicle as a function of vehicle velocity and determined drag coefficients, where the vehicle velocity and drag coefficients are the one or more characteristics. The moving resistance may thus be a function where velocity. Alternatively, loading, friction, or the like, may be the one or more characteristic.

The term "obtain" or "obtaining", as used in connection with data, signals, information and the like, includes at least one of i) accessing memory of the energy management system or of an external device or remote server where the data, signals, information, etc. are stored, ii) receiving the data, signals, information, etc. over a wireless communications link between the energy management device and a local external device, and/or iii) receiving the data, signals, information, etc. at a remote server over a network connection. The obtaining operation, when from the perspective of the energy management system, may include sensing new signals in real time, and/or accessing memory to read stored data, signals, information, etc. from memory within the energy management system. The obtaining operation, when from the perspective of a local external device, includes receiving the data, signals, information, etc. at a transceiver of the local external device where the data, signals, information, etc. are transmitted from an energy management device and/or a remote server. The obtaining operation may be from the perspective of a remote server, such as when receiving the data, signals, information, etc. at a network interface from a local external device and/or directly from an energy management device. The remote server may also obtain the data, signals, information, etc. from local memory and/or from other memory, such as within a cloud storage environment and/or from the memory of a workstation or local dispatch device. In one example a Davis equation, including drag coefficients may be obtained from the memory of an on-board computer of the vehicle management system.

At 304, one or more section of the one or more routes where movement of the vehicle system is to be restricted within one or more limits may be determined. In particular, the one or more routes of a trip may be segmented into different sections based on environmental parameters, vehicle parameters, or the like. In one example, the one or more routes are segmented based on a determined number with each section being an equal distance. In other example, each section may be a different distance. The sections may be based on state lines or boundaries, city boundaries, or country boundaries. Alternatively, sections may be based on terrain characteristics, include uphill, and downhill slopes, section curvatures, locations of curvatures, or the like. Sections may also be determined based restrictions such as speed limits, or areas where increased traffic may be anticipated.

Once the sections are defined, a determination regarding the movement restrictions may be provided. Specifically, while the one or more sections may be formed or determined based on speed restrictions in a section, in other examples sections are determined and selected based on another parameter or characteristic and the limits in each such section may then be determined. As indicated, in one example the movement restriction may be a speed restriction. For example, a section may have a determined speed limit as set by a regulatory authority. In other examples, traffic flow patterns of vehicles taking a similar route at a similar time of day may be used to predict when the speed of the vehicle may have to be reduced to accommodate traffic. Similarly, locations where a vehicle may need to make a stop to refuel, charge, load and unload passengers, etc. may also result on movement restrictions.

At 306, a modified version of the relationship between the moving resistance of the vehicle system and the one or more characteristics of the vehicle system may be determined. As indicated above, the relationship between the moving resistance of the vehicle system and the one or more characteristics of the vehicle system may include models, mathematical formulas, functions, quadradic equations, differential equations, etc. where the moving resistance may be accordingly determined including by using the one or more characteristics as variables in the determination.

In one example, the drag coefficients of a Davis equation may be varied as a function of speed restrictions. In particular, based on a speed restriction falling below a speed threshold, one or more drag coefficients are increased. So, if a section is determined to be around a populated area resulting in the average speed in the section for similar trips by similar vehicles to be thirty mile per hour (30 mph) whereas the average speed in other sections of the trip may be sixty (60) mph, the threshold speed may be forty-five (45) mph. When the average threshold speed may be determined to be below 45 mph, at least one drag coefficient may be increased. As a result, when fuel usage determinations are made, the increased drag coefficient results in a determination that operating at an increased speed may be detrimental to fuel consumption, reducing the speed in that section. In this manner, the modified version of the relationship may be modified responsive to determining the one or more sections of the one or more routes.

In another example, the at least one drag coefficient increases as a function of average speed decrease in a section. So, for each mph below the threshold speed, the at least one drag coefficient increases a determined amount. While described in relation to the drag coefficients, other variables utilized to determine the speed of the vehicle in a determined section may be varied as a function of speed to arrive at a similar result. In particular, by varying one or more characteristics as a function of reduced speed, a dynamic change in the response to the speed restriction occurs, instead of a static determination that the vehicle should just be operated at a constant speed in a determined section.

At 308, the trip plan may be generated or modified using the modified version of the relationship for movement of the vehicle system through the one or more sections of the one or more routes based on the modified version of the relationship. Specifically, the trip plan may be provided to designate one or more operational settings of the vehicle system for the upcoming trip to drive the movement of the vehicle system to achieve one or more objectives. In one example, the trip plan may be generated before a vehicle system embarks on the trip. The trip plan may then be used by a vehicle operator, or autonomously implemented by the vehicle system to guide the vehicle system during the trip.

Alternatively, an energy management system may receive signals, data, information, or the like during the trip and update and modify the trip plan accordingly during the trip. The signals, data, information, etc. may be received from vehicle system sensors, communications from other vehicle systems, communications from an off-board source such as a vehicle dispatch, etc. In one example, a dispatch may communicate to a vehicle system that an accident has occurred along the one or more routes, and as a result, delays, or reduced speeds in determined sections are anticipated. Based on the signal, the anticipated decrease in speed in the section may be inputted into the energy management system, resulting in an updated determination related to the relationship. In one example, the relationship may be modified to increase a value of at least one drag coefficient resulting in a modified trip plan.

Thus provided, is an energy management system and method for generating or modifying a trip plan. By determining where restrictions, such as speed restriction section will be along one or more routes of a trip, a relationship may be modified. By modifying the relationship, a dynamic variable may be provided for determining the movement of the vehicle system within along the section. Thus, instead of merely providing a static restriction on the vehicle system in a determined restriction section of a trip, the restriction may be dynamic, resulting in improved functioning of the vehicle system. This may include increased fuel efficiency, reduced emissions, improved trip speeds, etc.

In one or more embodiments, a method may be provided that includes determining a relationship between a moving resistance of a vehicle system and one or more characteristics of the vehicle system. The method may also include generating a trip plan based at least in part on the relationship for movement of the vehicle system through one or more sections of one or more routes based at least in part on the relationship, and designating one or more operational settings of the vehicle system for implementing the trip plan to drive movement of the vehicle system to achieve one or more objectives.

Optionally, determining the relationship between the moving resistance of the vehicle system and one or more characteristics of the vehicle system includes determining a tractive power using at least one speed dependent resistance coefficient. In one example, the at least one speed dependent resistance coefficient includes a drag coefficient associated with a linear component.

Optionally, the method may also include varying the one or more characteristics of the vehicle system to generate the trip plan. Varying the one or more characteristics of the vehicle system may be responsive to a reduction in a speed threshold in at least one section of the one or more sections.

Optionally, the method may include modifying the relationship based on speed constraints for the vehicle system associated with the one or more sections.

Optionally, the method may include modifying the relationship based on the traffic congestion data associated with the one or more sections. In one aspect, the traffic congestion data may be received while the vehicle system is on a trip, and the method may also include updating the relationship based on the traffic congestion data.

Optionally, the one or more operational settings may be one of a throttle setting, a notch setting, or a brake setting.

Optionally, the method may also include modifying the relationship based on one or more of vehicle system length, vehicle system weight, weight distribution of the vehicle system, wheel diameter, wheel lubricant system, wheel pressure, weather, grade of the one or more routes, or condition of the one or more routes.

In one or more examples, a system may be provided that may include a controller. The controller may include one or more processors that may be configured to determine a relationship between a moving resistance of a vehicle system and one or more characteristics of the vehicle system. The one or more processors may also be configured to generate a trip plan based at least in part on a relationship for movement of the vehicle system through one or more sections of one or more routes based at least in part on the relationship, and designate one or more operational settings of the vehicle system for implementing the trip plan to drive movement of the vehicle system to achieve one or more objectives.

Optionally, the one or more processors may also be configured to determine a speed constraint of at least one section of the one or more sections, and determine whether the speed constraint may be below a threshold speed limit.

Optionally, the one or more processors may also be configured to receive traffic congestion data associated with the speed constraint, or receive speed limit regulation data associated with the speed constraint.

Optionally, the one or more processors may be configured to permit the vehicle system to travel above the threshold speed limit when the vehicle system is in the at least one section of the one or more sections.

Optionally, the one or more processors may be configured to modify a tractive effort determination within the one or more sections to modify the relationship between the moving resistance of the vehicle system and the one or more characteristics of the vehicle system.

In one or more embodiment, a method may be provided that includes determining a relationship between a resistance of a vehicle system and one or more characteristics of the vehicle system. The relationship may include at least one drag coefficient. The method may also include generating a trip plan based at least in part on a relationship for movement of the vehicle system through one or more sections of one or more routes based at least in part on the relationship, and designating one or more operational settings of the vehicle system for implementing the trip plan to drive movement of the vehicle system to achieve one or more objectives. The method may also include determining a modified version of the relationship between the resistance of the vehicle system and the one or more characteristics of the vehicle system based on the one or more sections of the one or more routes.

Optionally, the method may also include varying the at least one drag coefficient to determine the modified version of the relationship between the resistance of the vehicle system and the one or more characteristic of the vehicle system.

Optionally, the method may also include predicting an average speed of the vehicle system during the one or more sections, and varying the at least one drag coefficient based on the average speed predicted.

Optionally, the at least one drag coefficient may be associated with a linear component of a tractive effort determination.

Optionally, the method may include obtaining the relationship between the resistance of the vehicle system along the one or more routes for the upcoming trip and the one or more characteristics of the vehicle system from an off-board memory of an off-board computer.

As used herein, the terms "processor" and "computer," and related terms, e.g., "processing device," "computing device," and "controller" may be not limited to just those integrated circuits referred to in the art as a computer, but refer to a microcontroller, a microcomputer, a programmable logic controller (PLC), field programmable gate array, and application specific integrated circuit, and other programmable circuits. Suitable memory may include, for example, a computer-readable medium. A computer-readable medium may be, for example, a random-access memory (RAM), a computer-readable non-volatile medium, such as a flash memory. The term "non-transitory computer-readable media" represents a tangible computer-based device implemented for short-term and long-term storage of information, such as, computer-readable instructions, data structures, program modules and sub-modules, or other data in any device. Therefore, the methods described herein may be encoded as executable instructions embodied in a tangible, non-transitory, computer-readable medium, including, without limitation, a storage device and/or a memory device. Such instructions, when executed by a processor, cause the processor to perform at least a portion of the methods described herein. As such, the term includes tangible, computer-readable media, including, without limitation, non-transitory computer storage devices, including without limitation, volatile and non-volatile media, and removable and non-removable media such as firmware, physical and virtual storage, CD-ROMS, DVDs, and other digital sources, such as a network or the Internet.

The singular forms "a", "an", and "the" include plural references unless the context clearly dictates otherwise. "Optional" or "optionally" means that the subsequently described event or circumstance may or may not occur, and that the description may include instances where the event occurs and instances where it does not. Approximating language, as used herein throughout the specification and claims, may be applied to modify any quantitative representation that could permissibly vary without resulting in a change in the basic function to which it may be related. Accordingly, a value modified by a term or terms, such as "about," "substantially," and "approximately," may be not to be limited to the precise value specified. In at least some instances, the approximating language may correspond to the precision of an instrument for measuring the value. Here and throughout the specification and claims, range limitations may be combined and/or interchanged, such ranges may be identified and include all the sub-ranges contained therein unless context or language indicates otherwise.

This written description uses examples to disclose the embodiments, including the best mode, and to enable a person of ordinary skill in the art to practice the embodiments, including making and using any devices or systems and performing any incorporated methods. The claims define the patentable scope of the disclosure, and include other examples that occur to those of ordinary skill in the art. Such other examples are intended to be within the scope of the claims if they have structural elements that do not differ from the literal language of the claims, or if they include equivalent structural elements with insubstantial differences from the literal language of the claims.

What is claimed is:

1. A method comprising: determining, with one or more processors of a controller of an energy management system, a relationship between a moving resistance of a vehicle system and one or more characteristics of the vehicle system, the vehicle system including at least two or more vehicles;

generating, with the one or more processors of the controller of the energy management system of the vehicle system, a trip plan based on the relationship for movement of the vehicle system through one or more sections of one or more routes;

designating, with the one or more processors of the controller of the energy management system of the vehicle system, one or more operational settings of the vehicle system for implementing the trip plan to drive the movement of the vehicle system to achieve one or more objectives;

determining, with the one or more processors of the controller of the energy management system of the vehicle system, a reduced speed section of the one or more sections;

obtaining, with the one or more processors of the controller of the energy management system of the vehicle system, a drag coefficient in real time based on the trip plan, the drag coefficient representative of an air resistance;

varying, with the one or more processors of the controller of the energy management system of the vehicle system, the drag coefficient within the reduced speed section based on a reduced speed of the reduced speed section; and varying, with at least one of a propulsion system or a braking system, vehicle speed of the vehicle system within the reduced speed section based on the drag coefficient by varying the one or more operational settings of the at least one of the propulsion system or the braking system.

2. The method of claim 1, wherein determining the relationship between the moving resistance of the vehicle system and the one or more characteristics of the vehicle system includes determining a tractive power using at least one speed dependent resistance coefficient.

3. The method of claim 2, wherein the at least one speed dependent resistance coefficient includes the drag coefficient associated with a linear component.

4. The method of claim 1, wherein generating the trip plan includes varying the one or more characteristics of the vehicle system to generate the trip plan.

5. The method of claim 4, wherein varying the one or more characteristics of the vehicle system occurs responsive to entering the reduced speed section of the one or more sections of the one or more routes.

6. The method of claim 1, further comprising modifying the relationship based on traffic congestion data associated with the one or more sections of the one or more routes.

7. The method of claim 6, wherein the traffic congestion data is received while the vehicle system is on a trip, and wherein the method further comprises: updating the relationship based on the traffic congestion data.

8. The method of claim 1, wherein the one or more operational settings includes a throttle setting, a speed setting, a gear setting, an auxiliary load setting, an energy storage device setting, or a brake setting.

9. The method of claim 1, further comprising modifying the relationship based on one or more of vehicle system length, vehicle system weight, weight distribution of the vehicle system, wheel diameter, wheel lubricant system, wheel pressure, weather, grade of the one or more routes, or condition of the one or more routes.

10. A system comprising: a controller including one or more processors configured to: determine a relationship between a moving resistance of a vehicle system and one or more characteristics of the vehicle system, the vehicle system including at least two or more vehicles;

generate a trip plan based on the relationship for movement of the vehicle system through one or more sections of one or more routes;

designate one or more operational settings of the vehicle system for implementing the trip plan to drive the movement of the vehicle system to achieve one or more objectives;

determine a reduced speed section of the one or more sections;

vary a drag coefficient within the reduced speed section based on a reduced speed of the reduced speed section, the drag coefficient representative of an air resistance; and automatically vary vehicle speed of the vehicle system with at least one of a propulsion system or a braking system within the reduced speed section based on the drag coefficient that varies by varying the operational settings of the vehicle system.

11. The system of claim 10, wherein the one or more processors are configured to: determine a speed constraint of at least one section of the one or more sections of the one or more routes, and determine whether the speed constraint is below a threshold speed limit.

12. The system of claim 11, wherein the one or more processors are configured to: permit the vehicle system to travel above the threshold speed limit while the vehicle system is in the at least one section of the one or more sections of the one or more routes.

13. The system of claim 10, wherein the one or more processors are configured to: modify a tractive effort determination within the one or more sections to modify the relationship between the moving resistance of the vehicle system and the one or more characteristics of the vehicle system.

14. A method comprising: determining, with one or more processors of a controller of an energy management system, a relationship between a resistance of a vehicle system and one or more characteristics of the vehicle system, the relationship including at least one drag coefficient, and the vehicle system including at least two vehicles;

generating, with one or more processors of the controller of the energy management system, a trip plan for movement of the vehicle system through one or more sections of one or more routes based at least in part on the relationship, the one or more sections including a reduced speed section;

designating, with the one or more processors of the controller of the energy management system, one or more operational settings of the vehicle system for implementing the trip plan to drive movement of the vehicle system to achieve one or more objectives;

determining, with the one or more processors of the controller of the energy management system, the vehicle system is within the reduced speed section;

obtaining, with the one or more processors of the controller of the energy management system, the at least one drag coefficient in real time, the drag coefficient representative of an air resistance;

determining, with the one or more processors of the controller of the energy management system, a modified version of the relationship between the resistance of the vehicle system and the one or more characteristics of the vehicle system based on the one or more sections of the one or more routes, varying, with the one or more processors of the controller of the energy management system, the at least one drag coefficient within the reduced speed section; and varying, with at least one of a propulsion system or a braking system, vehicle speed of the vehicle system by varying the one or more operational settings of the at least one of the propulsion system or the braking system within the reduced speed section based on varying the at least one drag coefficient.

15. The method of claim 14, further comprising varying the at least one drag coefficient to determine the modified version of the relationship between the resistance of the vehicle system and the one or more characteristics of the vehicle system.

16. The method of claim 15, further comprising: predicting an average speed of the vehicle system during the one or more sections of the one or more routes; and varying the at least one drag coefficient based on the average speed that is predicted.

17. The method of claim 14, wherein the at least one drag coefficient is associated with a linear component of a tractive effort determination.

18. The method of claim 14, further comprising obtaining the relationship between the resistance of the vehicle system and the one or more characteristics of the vehicle system from an off-board memory of an off-board computer.

19. The system of claim 11, wherein the operational settings include at least one of throttle settings, notch settings, or brake settings.

20. The method of claim 1, wherein the vehicle system is a rail vehicle system.

* * * * *